US008012575B2

(12) United States Patent
Müller

(10) Patent No.: US 8,012,575 B2
(45) Date of Patent: Sep. 6, 2011

(54) DUROPLASTIC-BONDED MOLDED FIBER PARTS AND METHOD FOR PRODUCING THE SAME

(75) Inventor: Franz-Josef Müller, Iserlohn (DE)

(73) Assignee: Momentive Specialty Chemicals Inc., Columbus, OH (US)

( * ) Notice: Subject to any disclaimer, the term of this patent is extended or adjusted under 35 U.S.C. 154(b) by 598 days.

(21) Appl. No.: 11/631,802

(22) PCT Filed: Jul. 14, 2005

(86) PCT No.: PCT/EP2005/007659

§ 371 (c)(1),
(2), (4) Date: Jul. 6, 2010

(87) PCT Pub. No.: WO2006/008062

PCT Pub. Date: Jan. 26, 2006

(65) Prior Publication Data

US 2010/0285314 A1 Nov. 11, 2010

(30) Foreign Application Priority Data

Jul. 15, 2004 (DE) ..... 10 2004 034 323

(51) Int. Cl.
*B32B 13/02* (2006.01)

(52) U.S. Cl. ..... 428/297.4; 428/301.4; 264/257

(58) Field of Classification Search ..... 502/402; 428/297.4, 301.4; 264/257
See application file for complete search history.

(56) References Cited

U.S. PATENT DOCUMENTS

| | | | | | |
|---|---|---|---|---|---|
| 573,070 | A | * | 12/1896 | Wood | 81/126 |
| 1,966,553 | A | * | 7/1934 | Kropp | 502/402 |
| 3,611,678 | A | * | 10/1971 | Holden | 502/402 |
| 3,715,869 | A | * | 2/1973 | Holden | 502/402 |
| 4,931,360 | A | * | 6/1990 | Hoshino et al. | 428/328 |
| 5,373,070 | A | | 12/1994 | Gardziella et al. | |
| 5,432,000 | A | * | 7/1995 | Young et al. | 428/372 |
| 5,837,627 | A | * | 11/1998 | Halabisky et al. | 442/385 |
| 6,124,028 | A | * | 9/2000 | Nagle et al. | 428/308.8 |
| 6,187,698 | B1 | * | 2/2001 | Muller | 442/320 |
| 6,653,521 | B1 | * | 11/2003 | Kurata et al. | 604/359 |
| 6,670,522 | B1 | * | 12/2003 | Graef et al. | 604/370 |
| 6,673,983 | B1 | * | 1/2004 | Graef et al. | 604/378 |
| 6,777,042 | B2 | * | 8/2004 | Hokkirigawa et al. | 428/34.1 |
| 7,238,403 | B2 | * | 7/2007 | Koslow et al. | 428/76 |
| 7,465,373 | B2 | * | 12/2008 | Graef et al. | 162/129 |
| 7,585,390 | B2 | * | 9/2009 | Nunn et al. | 162/147 |

FOREIGN PATENT DOCUMENTS

| | | |
|---|---|---|
| JP | 59169919 A | 9/1984 |
| WO | WO 98/11156 | 3/1998 |

* cited by examiner

*Primary Examiner* — N. Edwards

(57) ABSTRACT

The invention relates to thermoset-bound fiber moldings produced from fiber material based on natural and/or synthetic fibers and bound by means of a thermoset binder. To produce thermoset-bound fiber moldings which combine the good mechanical, acoustical and fire properties of phenolic-bound fiber moldings with an ideally complete absence of any odor due to phenolic resin, at least one adsorbent is embedded in the surface and/or in the interior of the fiber molding during the operation of pre- and/or end-curing the thermosetting binder.

13 Claims, No Drawings

DUROPLASTIC-BONDED MOLDED FIBER PARTS AND METHOD FOR PRODUCING THE SAME

The invention relates to thermoset-bound fiber moldings produced from fiber material based on natural and/or synthetic fibers and bound by means of a thermoset binder.

Moldings produced from fibers are used, for example, as climate-regulating sound-absorbing articles and shaped articles possessing high surface strength and splintering resistance in automobile vehicle construction for example. Such moldings are typically produced from nonwoven fibrous layers bound with phenolic resin by press molding with concurrent curing.

These products have the disadvantage that they occasionally, in particular after exposure to elevated temperatures and moisture, give off a noticeable odor which is mostly due to the curing agent (hexamethylenetetramine) and/or its aminic decomposition products.

In EP-A 0 254 807 this problem is solved by utilizing a binder comprising a pulverulent mixture of a non-thermoreactive phenolic resin and one or more condensation products selected from the group consisting of phenolic resins, amino resins and epoxy resins. True, the odor due to hexamethylenetetramine is avoided as a result, but there remains a residual odor emanating from the phenolic resin.

The invention therefore has for its object to produce thermoset-bound fiber moldings which combine the good mechanical, sound-absorbing and fire properties of phenolic-bound fiber moldings with an ideally complete absence of an odor due to phenolic resin.

This object is achieve by thermoset-bound fiber moldings wherein at least one adsorbent is embedded in the surface and/or in the interior of the fiber molding during the operation of pre- and/or end-curing the thermosetting binder.

It is particularly surprising that, once the thermoset-bound fiber molding has been produced (under heat and pressure) in an operation which is generally accompanied by the release of a sufficient quantity of products to suppose that the take-up ability of the absorbent might be exhausted, the capacity of the absorbent is still sufficient to subsequently take up odor-forming products during the use of the fiber molding.

It is particularly preferable for the adsorbent to be present in a concentration of 1 to 30 parts by weight and preferably 15 to 20 parts by weight based on the thermosetting binder.

To ensure good mixing between the binder and the adsorbent during the manufacturing operation, it is advantageous when the particle size of the adsorbent matches that of the binder to the extent that the difference in particle size from that of the binder should not exceed ±20%.

Useful adsorbents include various prior art materials, examples being silica gel, zeolites or aluminosilicates. However, it is particularly preferable for the adsorbent to be activated carbon. The specific properties of activated carbon cause almost no changes in the flow behavior, in the reactivity or else in the melting behavior during the production of the thermoset-bound fiber molding.

Useful thermosetting binders include all resin, whether self-curing or provided with a curing agent or curing catalyst, which cure above a certain temperature to form a high polymer. Useful resins include diallyl phthalate, epoxy, urea, melamine, melamine-urea, melamine-phenol, phenolic and unsaturated polyester resins and corresponding combinations. The binder may further include the customarily used stearates, silica, lubricants, internal release agents and/or flame retardants.

Preferred binders are those based on phenolic resin and/or epoxy resin and/or epoxy-polyester resin mixtures, and different compositions can be present. It is also possible to use powder coating residues from the paints and coatings industry.

As binders based on phenolic resin it is possible to use any condensation product of a phenolic compound and an aldehyde, in particular a condensation product of phenol, cresol or xylenol and formaldehyde, not only resoles buy also customary mixtures of novolac and curing agent, in particular novolac-hexamethylenetetramine mixtures. The phenolic resins used are generally pulverulent. Binders based or epoxy resin are generally pulverulent mixtures of epoxy compounds having at least two epoxide groups per molecule and a curing agent. Preferred curing agents are latent curing agents or at least curing agents which permit adequate processing time between the time of mixing and the time of curing. Examples thereof are acid anhydrides, imidazole derivatives, but preferably novolacs or metal complex compounds as known for example from EP-B 0 518 908.

It is preferable to introduce the adsorbent into or onto the fiber material, as the case may be, in a combination, i.e. mixture, with the thermosetting binder. This way, no additional process step is needed to endow the fiber molding with the adsorbent. But, in general, it is also possible to place a mat composed of a blend comprising adsorbent onto the uncured fiber molding (intermediate and/or finished article) and so effect the embedding of the adsorbent during the curing operation.

Useful fibers include inorganic fibers such as glass fibers for example and also organic fiber like material or any desiree fiber blends. Preference is given to organic fibers such as wool, cotton, viscose rayon staple, jute, flax, hemp, polyester or acrylic fibers and blends thereof. A large proportion of the fiber material used is obtained from waste textiles via a pulling operation.

These fibers are processing by conventional processes (examples being air laying and carding) to mix them with the respective binders and lay down individual fibrous layers (webs, for example card webs). The ratio of binder to fiber can vary according to the intended field of use and is between 10-40:90-60. The individual fibrous layers or the laid intermediate articles thus produced are cut to size in a conventional manner and can be either procured (to be end-cured later in the course of a shaping operation) or immediately cured as flat product at temperatures above the curing temperatures of the thermosetting binders.

The thermoset-bound fiber molding of the present invention is preferably produced by air laying. In the air-laying process, the pre-opened fiber material is further divided and carried by an airstream to a foraminous roll where it is laid down to form a web. The binder and the absorbent are simultaneously and/or separately sprinkled in powder form into the web via rolls, vibrating chutes or similar metering means. A downstream system provides a fluidizing action to ensure intensive and uniform distribution of the binder in the web material. Thereafter, the now binder-containing fiber material is aspirated back down to the cross section of the fibrous sheet in a nip formed between suction rolls and is again laid down to form a web.

This web sheet is briefly heated such that the thermosetting binders melt and fix to the fiber, but do not cure. Thereafter, the web sheet is cooled down and end itemed. The intermediate articles thus produced are finally pressed and cured in a conventional manner with or without shaping, and this may again be done by superposing a plurality of these intermediate articles before pressing them together and curing.

The curing of the binder and hence the ultimate consolidation of the fiber webs to form a nonwoven fabric can likewise be effected by various techniques (the hot cold press process or preferably the hot press process). In the hot press process, the web is predried/procured at comparatively low temperatures in a curing duct and appropriately molded in a subsequent hot-pressing operation.

The invention will now be more particularly described by way of example with reference to an illustrative embodiment:

EXAMPLE

The binder Bakelite® PF 7077 TP (product of Bakelite AG, Germany) was admixed with the stated amounts of activated carbon (based on the binder), this mixture was applied to the fiber material and distributed in the fiber web, and this was followed by pressing at 190° C. for 5 min to cure the binder. The component was then heated at 80° C. or 100° C. for 5 h and analyzed by gas chromatography. The reported values are averages of the area below the curve from 3 measurements:

| | Mean total area Measurement at 5 h | | Mean area of fast volatiles Measurement at 5 h | | Mean area of slow volatiles Measurement at 5 h | | Mean area of phenol Measurement at 5 h | |
|---|---|---|---|---|---|---|---|---|
| Constituent | 80° C. | 100° C. | 80° C. | 100° C. | 80° C. | 100° C. | 80° C. | 100° C. |
| Pure Bakelite ® PF 7077 TP binder: phenol novolac with hexamethylenetetramine and reaction accelerant | 11354 | 25030 | 809 | 2119 | 10545 | 22911 | 8094 | 15013 |
| Pure fibre: pulled cotton with 15%-30% synthetic fibre | 9398 | 45457 | 7517 | 40886 | 1881 | 4571 | 31 | 504 |
| Pure activated carbon: ABP 850 (from Adaks-Pica GmbH, Germany) pulverulent | 208 | 1167 | 208 | 1049 | 0 | 91 | 0 | 0 |
| Binder with 5% of activated carbon | 3038 | 12720 | 716 | 9038 | 2322 | 3682 | 2395 | 492 |
| Binder with 10% of activated carbon | 314 | 9022 | 314 | 6570 | 0 | 2477 | 0 | 0 |
| Binder with 15% of activated carbon | 328 | 6496 | 328 | 4829 | 0 | 1666 | 0 | 0 |

The table reveals that the addition of just 5% of activated carbon is sufficient to distinctly reduce the emission of phenols at least. These results suggest that thermoset fiber moldings produced by conventional processes will no longer release odorants in use even under extreme conditions (hot, humid air). Losses in relation to other properties such as mechanical, sound-absorbing and fire properties were not observed.

I claim:

1. Thermoset-bound fiber moldings comprising a fiber material based on natural fibers, or synthetic fibers or based on natural fibers and synthetic fibers, and bound by means of a thermoset binder, wherein at least one adsorbent is embedded in a surface or in an interior of the fiber molding during the operation of pre- or end-curing the thermosetting binder, wherein the adsorbent is present in a concentration of 1 to 30 parts by weight based on the thermosetting binder.

2. The thermoset-bound fiber moldings of claim 1, wherein the adsorbent is present in a concentration of 15 to 20 parts by weight based on the thermosetting binder.

3. The thermoset-bound fiber moldings of claim 1, wherein the adsorbent has a particle size which matches that of the binder.

4. The thermoset-bound fiber moldings of claim 1, wherein the adsorbent is activated carbon.

5. The thermoset-bound fiber moldings of claim 1, wherein the binder comprises a phenolic resin, an epoxy resin, and/or an epoxy-polyester resin mixture.

6. A process for producing the thermoset-bound fiber moldings of claims 1 comprising embedding the adsorbent in admixture with the thermosetting binder during the production of the thermoset fiber molding.

7. The process of claim 6, wherein the process as an aerodynamic process.

8. The process of claim 6, wherein the molding has a shaping effected by hot pressing.

9. The thermoset-bound fiber moldings of claim 1, wherein the fiber material comprises glass fibers or an organic fiber like material, or combinations thereof.

10. The thermoset-bound fiber moldings of claim 1, wherein the organic fiber like material is selected from the group consisting of wool, cotton, viscose rayon staple, jute, flax, hemp, polyester fibers, acrylic fibers, and combinations thereof.

11. The thermoset-bound fiber moldings of claim 1, wherein the adsorbant material is selected from the group of silica gel, zeolites, aluminosilicates, and activated carbon.

12. The thermoset-bound fiber moldings of claim 1, wherein the thermoset binder comprises a material selected from the group of diallyl phthalate resins, epoxy resins, urea resins, melamine resins, melamine-urea resins, melamine-phenol resins, phenolic resins, unsaturated polyester resins, and combinations thereof.

13. The thermoset-bound fiber moldings of claim 12, wherein the thermoset binder further comprises a material selected from the group consisting of stearates, silica, lubricants, internal release agents, flame retardants, and combinations thereof.

* * * * *